US007540056B2

(12) United States Patent
Dotterman et al.

(10) Patent No.: US 7,540,056 B2
(45) Date of Patent: Jun. 2, 2009

(54) CLEANING TOOL

(75) Inventors: Perry S. Dotterman, Maplewood, MN (US); Scott J. Tuman, Woodbury, MN (US); Diane R. Wolk, Woodbury, MN (US); John M. Simon, Edina, MN (US); Mark D. Sorlien, White Bear Lake, MN (US); Mark W. Nelson, Lino Lakes, MN (US); Michael J. Kubes, Oakdale, MN (US); Byron E. Trotter, St. Paul, MN (US); Arthur V. Lang, Maplewood, MN (US); Johannes N. Gaston, Minnetonka, MN (US); Douglas J. VanOrnum, Minnetonka, MN (US); Steven A. Beaudry, Minneapolis, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 640 days.

(21) Appl. No.: 11/262,589

(22) Filed: Oct. 31, 2005

(65) Prior Publication Data

US 2007/0094829 A1 May 3, 2007

(51) Int. Cl.
*A47L 13/24* (2006.01)

(52) U.S. Cl. ..... 15/228; 15/147.2; 15/231; D32/50

(58) Field of Classification Search ..... 15/147.1, 15/147.2, 220.1, 228, 231, 232; 451/523–525; D32/35, 40, 50–52
See application file for complete search history.

(56) References Cited

U.S. PATENT DOCUMENTS

| | | | | |
|---|---|---|---|---|
| 1,186,960 A | | 6/1916 | Wells | |
| 1,378,243 A | * | 5/1921 | Kracke | 15/220.1 |
| 1,420,180 A | | 6/1922 | Casmire | |
| 1,643,637 A | | 9/1927 | Chadwick | |
| 1,998,278 A | | 4/1935 | Halsey | |
| D100,668 S | | 8/1936 | Lofgren | |
| 2,212,172 A | | 8/1940 | Veeck | |
| 2,214,519 A | | 9/1940 | Bailey | |
| 2,304,127 A | * | 12/1942 | Stetson | 15/231 |
| D152,843 S | | 2/1949 | Wagner | |
| D185,727 S | | 7/1959 | Yamen | |
| 3,319,278 A | | 5/1967 | Frazer | |
| 3,395,416 A | * | 8/1968 | Martin | 15/228 |
| 3,465,377 A | | 9/1969 | Thomas | |
| 3,528,120 A | | 9/1970 | Lindstrom | |
| 3,720,976 A | | 3/1973 | Bailey | |
| D245,473 S | | 8/1977 | Heninger | |
| 5,323,506 A | | 6/1994 | Babitch | |

(Continued)

FOREIGN PATENT DOCUMENTS

| | | | |
|---|---|---|---|
| JP | 8-131388 | * | 5/1996 |
| JP | 15-000511 A | | 1/2003 |
| JP | 17-160770 A | | 6/2005 |
| KR | 20-0282787 Y1 | | 7/2005 |
| WO | WO 2005/023080 | | 3/2005 |

*Primary Examiner*—Mark Spisich
(74) *Attorney, Agent, or Firm*—Trisha D. Adamson

(57) ABSTRACT

The present invention relates to a floor cleaning tool. In one embodiment the floor cleaning tool comprises a backing and a handle. The backing comprises a first surface and a second surface. The handle is attached to the second surface of the backing apparatus. The backing has a generally triangular perimeter having a first edge, a second edge, and a third edge. A portion of the first edge is curved and a portion of the second edge is curved. The first edge and second edge meet at a leading point. The third edge is concave. The floor cleaning tool is capable of supporting a wipe.

13 Claims, 4 Drawing Sheets

U.S. PATENT DOCUMENTS

| | | | | |
|---|---|---|---|---|
| D349,375 | S | | 8/1994 | Berti |
| 5,347,679 | A | | 9/1994 | Saunders et al. |
| 5,470,272 | A | | 11/1995 | Kikuchi et al. |
| 5,479,673 | A | | 1/1996 | Carton |
| D374,750 | S | | 10/1996 | Vanderhoef et al. |
| 5,596,787 | A | | 1/1997 | Stevens et al. |
| 5,603,138 | A | * | 2/1997 | Bonis ..... 15/220.1 |
| 5,625,918 | A | | 5/1997 | Kieson et al. |
| 5,702,195 | A | * | 12/1997 | Rittenbaum ..... 401/289 |
| 5,862,565 | A | | 1/1999 | Lundstedt |
| 5,875,511 | A | | 3/1999 | Nejdl |
| D413,417 | S | | 8/1999 | Reede |
| D414,005 | S | | 9/1999 | Lehnertz |
| D414,342 | S | | 9/1999 | Ancona et al. |
| D423,743 | S | | 4/2000 | Dawson et al. |
| 6,044,513 | A | | 4/2000 | Penn |
| 6,073,298 | A | | 6/2000 | O'Brien |
| D468,878 | S | | 1/2003 | Reede |
| 6,523,213 | B1 | | 2/2003 | Post |
| D471,334 | S | | 3/2003 | Reede |
| 6,543,950 | B1 | | 4/2003 | Huang |
| 6,769,153 | B1 | | 8/2004 | Post et al. |
| 6,895,626 | B2 | | 5/2005 | Tsai |
| 2003/0009839 | A1 | | 1/2003 | Streutker et al. |
| 2003/0110584 | A1 | | 6/2003 | Clare et al. |
| 2004/0031506 | A1 | | 2/2004 | Tsai |
| 2004/0141794 | A1 | | 7/2004 | Slaboden |
| 2004/0177461 | A1 | | 9/2004 | Ajluni |
| 2004/0184867 | A1 | | 9/2004 | Wang et al. |
| 2005/0060827 | A1 | | 3/2005 | James et al. |

* cited by examiner

CLEANING TOOL

FIELD

The present invention relates to cleaning tools. More particularly, the present invention relates to floor cleaning tools capable of supporting a wipe.

BACKGROUND

Various types of floor cleaning tools are used by consumers to clean floors. Brooms and mops are examples of such tools. Brooms are effective at cleaning corners because the bristles can reach into the corner and pull out dirt. However, the broom itself cannot pick-up dirt and debris and cannot remove dirt and debris stuck to the floor.

Fabric mop heads, which have strings or yarn extending from the mop head, are another type of floor cleaning tool. Floor cleaning tools may also have a sponge mop head. Both of these types of cleaning tools are capable of retaining water. Typically, a user must use a separate chemical cleaning product with the water in order to clean the floor. Using a separate cleaning product may be messy and requires the consumer to store harsh chemical in their house, which may be a risk to pets and children.

Various problems exist with use of fabric and sponge mop heads. Fabric mop heads and sponge mop heads themselves become dirty from the dirt and debris on the floor. Therefore, the consumer must clean the mop head or risk spreading the dirt across the floor. Cleaning the mop head presents difficulties. In a fabric mop head, hair may become tangled and trapped in the various strings of the mop head. Food, dirt, or other debris may stain the fabric or sponge material or may carry bacteria and germs, which may grow in the environment of the mop head. Then, during future use, a consumer may spread the bacteria and germs during the cleaning process.

Cleaning tools that use a wipe over a mop head have been developed to address many of these problems associated with fabric and sponge mop heads. Often the wipe is disposable to assist with clean-up. The mop head and wipe are pushed across the floor, and the dirt and debris typically attach to the leading edge. Typically, the tools are rectangular shape and when dirt gets into corners, it is difficult to remove. Also with rectangular tools, the user has difficulty collecting and capturing larger objects. These objects tend to be pushed beyond the leading edge and spill around the leading edge. What is needed is a mop head for use with a wipe that allows for easy access into corners and hard-to-reach places.

SUMMARY

The present invention relates to a floor cleaning tool. In one embodiment the floor cleaning tool comprises a backing and a handle. The backing comprises a first surface and a second surface. The handle is attached to the second surface of the backing. The backing has a generally triangular perimeter having a first edge, a second edge, and a third edge. A portion of the first edge is curved and a portion of the second edge is curved. The first edge and second edge meet at a leading point. The third edge is concave. The floor cleaning tool is capable of supporting a wipe.

In another embodiment, the floor cleaning tool comprises a backing and a handle. The backing comprises a first surface and a second surface. The handle is attached to the second surface of the backing. The backing has a generally triangular perimeter having a convex first edge, a convex second edge, and a concave third edge. The convex first edge includes a recessed portion for receiving a hook extension for attachment to the wipe. The convex second edge includes a recessed portion for receiving a hook extension for attachment to the wipe. The floor cleaning tool is capable of supporting a wipe.

In another embodiment, the floor cleaning tool comprises a backing, a handle, and a compliant support. The backing comprises a first surface and a second surface. The handle is attached to the second surface of the backing. The compliant support is attached to the first surface of the backing. The backing has a generally triangular perimeter having a first edge, a second edge, and a third edge. The first edge includes a concave portion and a linear portion, the second edge includes a concave portion and a linear portion, and the third edge is concave. The floor cleaning tool is capable of supporting a wipe.

While the above-identified drawings and figures set forth embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of this invention. The figures may not be drawn to scale.

DETAILED DESCRIPTION

Figure 1:
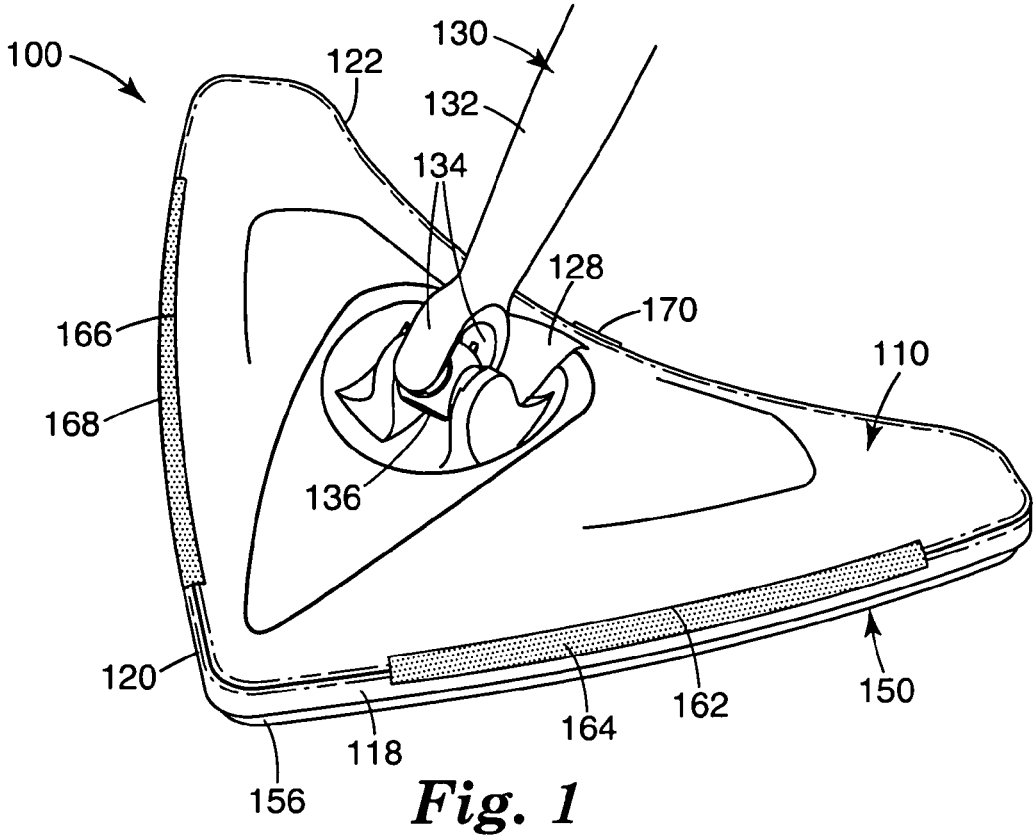
FIG. 1 is a perspective view of one embodiment of a cleaning tool according to the present invention.
Figure 2:
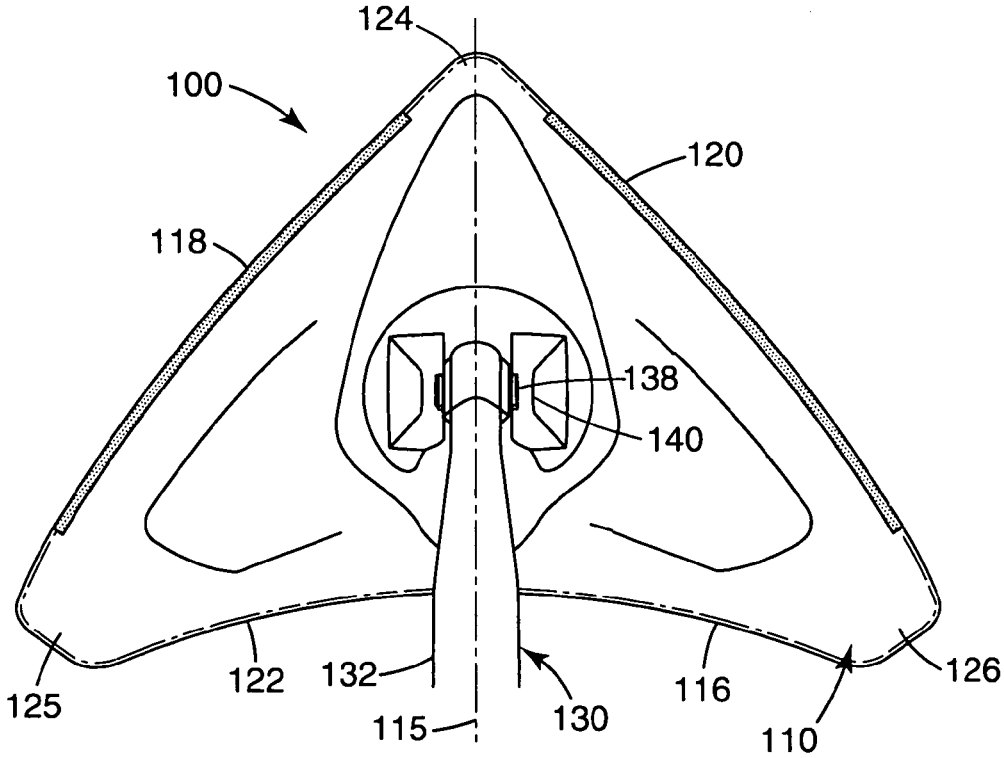
FIG. 2 is a top view of the cleaning tool of FIG. 1.
Figure 3:
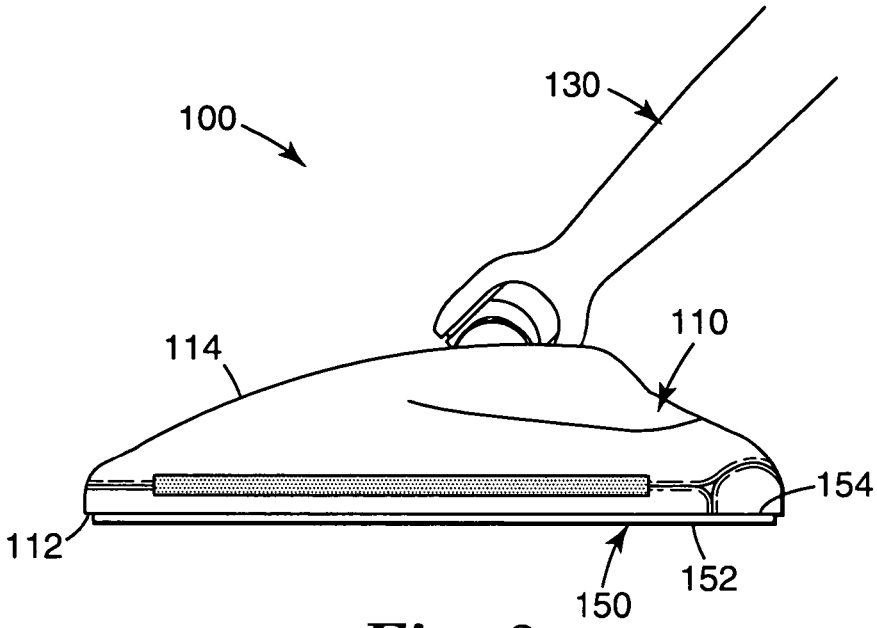
FIG. 3 is a side view of the cleaning tool of FIG. 1.

FIG. 1 is a perspective view of one embodiment of a cleaning tool 100 according to the present invention. FIG. 2 is a top view of the cleaning tool 100 of FIG. 1, and FIG. 3 is a side view of the cleaning tool 100 of FIG. 1. The floor cleaning tool 100 includes a backing 110, a handle 130, a compliant support 150, and a wipe 180 (shown attached to the cleaning tool 100 in FIG. 4).

The backing 110 is constructed of a rigid material such as metal or plastic. The backing 110 includes a first surface 112 and a second surface 114. Overall, the backing 110 includes a generally triangular perimeter 116 with a leading point 124, a left trailing corner, and a right trailing corner. The backing 110 is generally symmetrical about a longitudinal axis 115. The triangular perimeter 116 comprises a first edge 118, a second edge 120, and a third edge 122.

The first edge 118 and second edge 120 meet to form a leading point 124. Preferably, leading point 124 forms nearly an angle of approximately 90 degrees or less so as to fit into corners during cleaning. Typically, during use, the consumer will push the cleaning tool 100 with the leading point 124 leading the cleaning tool 100. However, it is understood that the cleaning tool 100 may be used in any direction and reference to leading, trailing, left, or right are intended solely for definitional purposes and are not intended to be limiting.

The first edge 118 and second edge 120 are curved edges and more particularly are convexly curved. Typically the radius of curvature for the convexly curved first edge 118 and second edge is 15 to 25 inches (38 to 63.5 cm), preferably 19 to 22 inches (48 to 56 cm). In the embodiments shown in FIGS. 1-4 the radius of curvature is approximately 21 inches (54 cm). The third edge 122 is also a curved edge and more particularly is concavely curved. The third edge 122 typically has a radius of curvature of 7 to 11 inches (18 to 28 cm), preferably 8 to 10 inches (20 to 25 cm). In the embodiments shown in FIGS. 1-4 the radius of curvature is approximately 9 inches (23 cm).

The concave third edge 122 with the extending left trailing corner 125 and right trailing corner 126 allows a user to maneuver the cleaning tool 100 around and reach into a corner, under furniture, or against a base board and scoop dirt, debris, or other large deposit into the recessed portion of the concave third edge 122.

The handle 130 attaches to the second surface 114 of the backing 110. The handle 130 includes a longitudinal shaft 132. The longitudinal shaft 132 may be constructed of any rigid material such a wood, metal, or plastic. The longitudinal shaft 132 may be stationary or extendable. An extendable handle 130 may have a twist-and-lock feature or may have a telescoping feature with individual lock sections. The handle 130 may have any known gripping means such as a contoured plastic handle or compliant foam over layer.

Extending from the handle 130 are two legs 134 that attach to a rotary joint 136. The rotary joint includes opposing pins 138 that extend into sockets 140 on the backing 110. The pins 138 are moveable within the sockets 140 to allow the handle 130 to actuate linearly along the direction of the longitudinal axis 115. Other types of handle attachment mechanisms are known in the art and may be utilized to attach the handle 130 to the backing 110. Such attachment mechanisms may allow for linear movement or rotational movement.

The backing 110 includes a handle contour 128, which is a depression for receiving the longitudinal shaft 132 of the handle 130. The handle contour 128 allows the user to extend the handle 130 to be parallel with the floor and not have the handle 130 interfere with the backing 110. The handle contour 128 may be constructed so as to lock with the longitudinal shaft 132. Therefore, when the cleaning tool 100 is not being used, the user can lock the longitudinal shaft 132 into the handle contour 128 and store the cleaning tool 100.

The compliant support 150 includes a first surface 152 and a second surface 154. The second surface 154 attaches to and extends from the first surface 112 of the backing 110. Overall, the compliant support 150 includes a perimeter 156. Typically the perimeter 156 mimics the triangular perimeter 116 of the backing 110. In this embodiment, the perimeter 156 of compliant support 150 is contained within the perimeter 116 of the backing 110, as can be seen in FIGS. 1 and 2.

Figure 4:
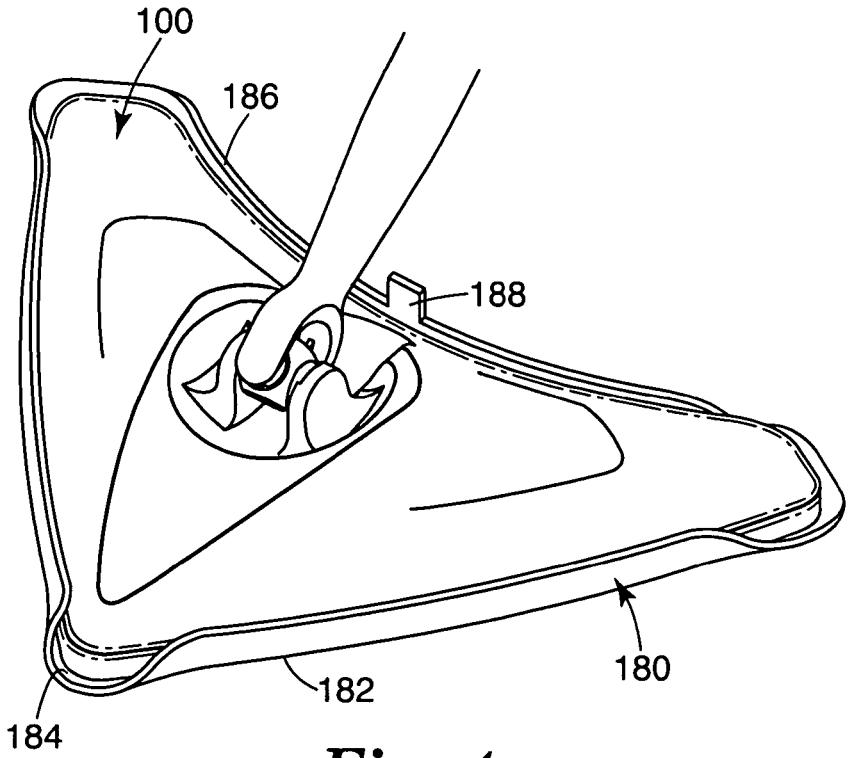
FIG. 4 is a perspective view of the cleaning tool of FIG. 1 with a wipe attached.

The compliant support 150 provides a surface for supporting the wipe 180 (see FIG. 4). The first surface 152 of the compliant support may be smooth or textured in a variety of patterns. The compliant support 150 can be constructed of any compliant material such as, but not limited to, plastic, rubber, foam, closed-cell foam, foamed polyurethane and other foamed synthetic and natural materials. In some embodiments, the compliant support 150 is capable of retaining water.

FIG. 4 is a perspective view of the cleaning tool 100 of FIG. 1 with a wipe 180 attached. The wipe 180 includes a first surface 182 and a second surface 184 for attaching to the cleaning tool 100. The wipe 180 covers the entire first surface 152 of the compliant support 150. Typically, the wipe 180 has a perimeter 186 that matches the perimeter 116 of the backing and the perimeter 156 of the compliant support 150. In the embodiment shown in FIG. 4, the perimeter of the wipe 180 matches the perimeter 116 of the backing and the perimeter 156 of the compliant support 150 but is larger than both perimeters. Therefore, the wipe 180 is able to wrap up and over the compliant support 150 and the first edge 118, second edge 120, and third edge 122 of the backing 110. The wipe 180 may include a pull tab 188 to assist with removing the wipe 180 from the cleaning tool 100.

The wipe 180 may be made of any knitted woven or nonwoven material. The wipe 180 may include areas of adhesive on the first surface 182 for picking up debris. The wipe 180 may include areas of increased adhesive, for example along the third edge 122 where larger particles may be captured. The wipe 180 may include ridges or other types of surface texturing or embossing to create high regions and low regions. The wipe 180 may include a preloaded chemical, surfactant, fragrance, or bleach. The wipe 180 may be dry or wet.

Suitable wipes for use with the cleaning tool are disclosed in the following U.S. patent applications, the disclosures of which are hereby incorporated by reference: Ser. No. 10/093,792 titled "A Wipe" filed on Mar. 8, 2002; Ser. No. 11/045,587 titled "Cleaning Wipe with Variable Loft Working Surface" filed on Jan. 28, 2005; Ser. No. 11/112,684 titled "Cleaning Sheet and Method of Making" filed on May 22, 2005.

The wipe 180 shown in FIG. 4 is attached to the cleaning tool. On the first edge 118 of the backing 110 is a first perimeter recess 162 where a first hook extension 164 is housed. (FIGS. 1-3). On the second edge 120 of the backing 110 is a second perimeter recess 166 where a second hook extension 168 is housed. (FIGS. 1-3) A third hook extension 170 is located near the third edge 122. The third hook extension 170 may be within a recessed portion. The lofty nonwoven material of the wipe 180 functions as the loop for attaching to the hook extensions secured to the backing 110. In other embodiments, the wipe 180 may have a loop material attached to it at predetermined areas.

Although hooks are described other types of mechanical fasteners typically in the shape of a hook or barb may be used. These fasteners engage with the wipe and provide for a disengagable fastening. Further, although it is described that the backing has recessed portions for receiving hook extensions, it is understood that the hooks or barbs may also be integrally molded into the backing portion of the cleaning tool.

The first and second hook extensions 164, 168 are positioned within recesses so that when the wipe attaches to the hook extensions 164, 168 a smooth first edge 118 and second edge 120 are available for cleaning adjacent surfaces, such as baseboards, mopboards, and furniture. Having the wipe 180 wrap around and cover a portion of the edges, as shown in FIG. 4, can be advantageous for cleaning adjacent surfaces without having to lift the cleaning tool 100 from the floor.

The wipe 180 is shown attached to the cleaning tool 100 by hook and loop. However, any know attachment mechanism may be used such as adhesive, mechanical fasteners, and pinch point depressions. The attachment mechanism may be located on the second surface 114 of the backing, the perimeter edges (as shown in FIG. 4), on the first surface 152 of the compliant support 150, on all of these surfaces, or any combination thereof. The wipe 180 may or may not wrap around the backing 110. For example, hook tabs may be located on the first surface 152 of the compliant support 150 for attaching to the nonwoven wipe 180, i.e., loop.

The cleaning tool 100 of the present invention is particularly suited for use as a floor cleaning apparatus. In one embodiment, the shape of the cleaning tool 100 shown in FIG. 1-4 has an overall length from left trailing corner 125 to right trailing corner 126 of approximately 12 inches (30 cm) and an overall length, along the longitudinal axis 115, from leading point 124 to either left trailing corner 125 or right trailing corner 126 of approximately 8 inches (20 cm). The overall perimeter of the cleaning tool 100 is 31 inches (79 cm) leading to an area of 45 square inches (290 $cm^2$).

Typically the cleaning tool 100 has an overall height (shown by the side view in FIG. 2) that allows at least the left trailing corner 125 and right trailing corner 126 of the cleaning tool 100 to extend under furniture and cabinets. In one embodiment, the height at the left trailing corner 125 and right trailing corner 126 is less than 4 inches (10 cm). Preferably, the height at the left trailing corner 125 and right trailing corner 126 is less than 2 inches (5 cm).

To use the cleaning tool 100, a user covers the first surface 152 of the compliant support 150 with the wipe 180. Then, depending on the attachment mechanism, if as shown in FIG. 4, the user wraps the wipe 180 around the first perimeter edge 118 and second perimeter edge 120 while making contact with the hook extensions 164, 168. The wipe 180 is folded up over the concave third edge 122 and attached to the third hook extension 170.

Once the wipe 180 is attached to the cleaning tool 100, the user pushes the cleaning tool 100 across a floor by maneuvering the handle 130. The wipe 180 collects dust and debris. To reach into corners, the user can present the leading point 124 into a corner to collect dust and debris. Alternatively, the user can present either left trailing corner 125 or right trailing corner 126 into a corner to scoop out dirt and debris. The left trailing corner 125 or right trailing corner 126 may also be used to scoop under furniture or cabinets, which cannot be easily reached by a user. The concave third edge 122 is able to retain large particles for disposal.

If the user pushes and leads the cleaning tool 100 with leading point 124, then first edge 118 and second edge 120 form the leading edge. If the user pushes and leads the cleaning tool 110 with the third edge 122, then the third edge 122 forms the leading edge. Typically, most of the dirt and debris is picked up at the leading edge. The present invention includes a cleaning tool 100 with an expanded leading edge to increase pick-up of dirt and debris.

The cleaning tool may be used as either a dry mop or wet mop depending on the type of wipe used. A dry wipe 180 may be provided with adhesive portion to assist with pickup of dirt and debris. If a wet mop is desired, a user will either wet a provided dry wipe 180 or a presoaked wet wipe 180 will be provided to the consumer. A dry wipe 180 may be preloaded with cleanser so that when moistened the cleanser is released during cleaning. A presoaked wet wipe 180 may also be provided with a cleanser.

In some embodiments, the compliant support 150 may be constructed of closed-cell foam that is capable of retaining water. Such a construction may be desirable if utilizing a wet wipe 180. The compliant support 150 will be capable of maintaining a desirable level of moisture to the wipe 180 for cleaning.

Figure 5:
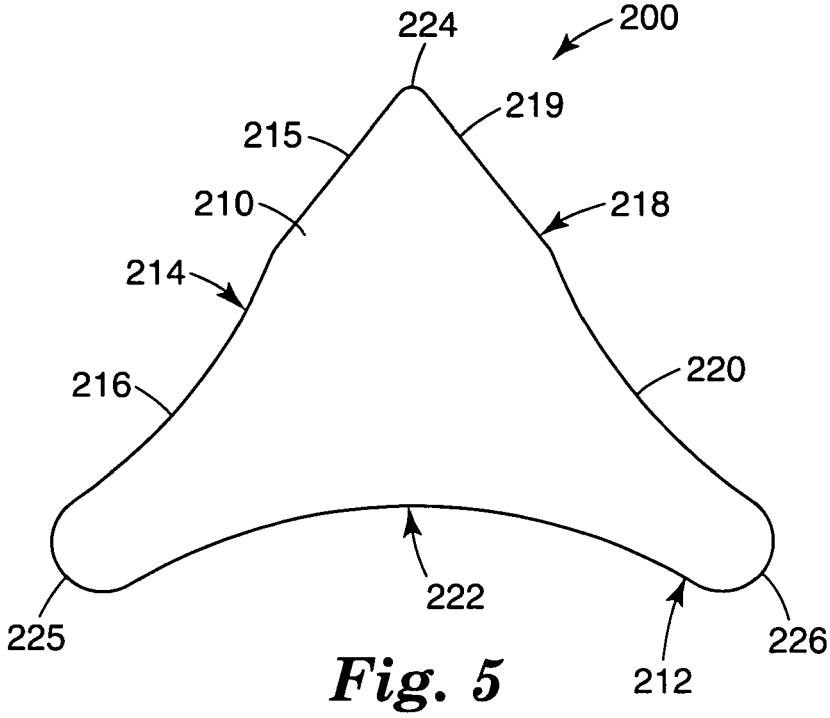
FIG. 5 is a bottom view of an alternative cleaning tool according to the present invention.

FIG. 5 is a bottom view of an alternative cleaning tool 200 according to the present invention. The cleaning tool 200 includes a backing 210 having an overall generally triangular perimeter 212 having a leading point 224, a left trailing corner 225, and a right trailing corner 226. The perimeter 212 includes a first edge 214, a second edge 218, and a third concave edge 222. The first edge 214 has a linear portion 215 and a concavely curved portion 216. The second edge 218 has a linear portion 219 and a concavely curved portion 220. The linear portions 215, 219 meet to form the leading point 224.

An exemplary embodiment of cleaning tool 200 has dimensions of approximately 12 inches (30 cm) by 8.5 inches (22 cm) leading to an overall perimeter of approximately 33 inches (84 cm) and an area of 45 square inches (290 $cm^2$). The concave third edge 222 has a radius of curvature of approximately 9 inches (23 cm), and each concave curved portion 216, 220 has a radius of curvature of approximately 9 inches (23 cm). The leading point 224 is approximately a 77 degree angle.

Figure 6:
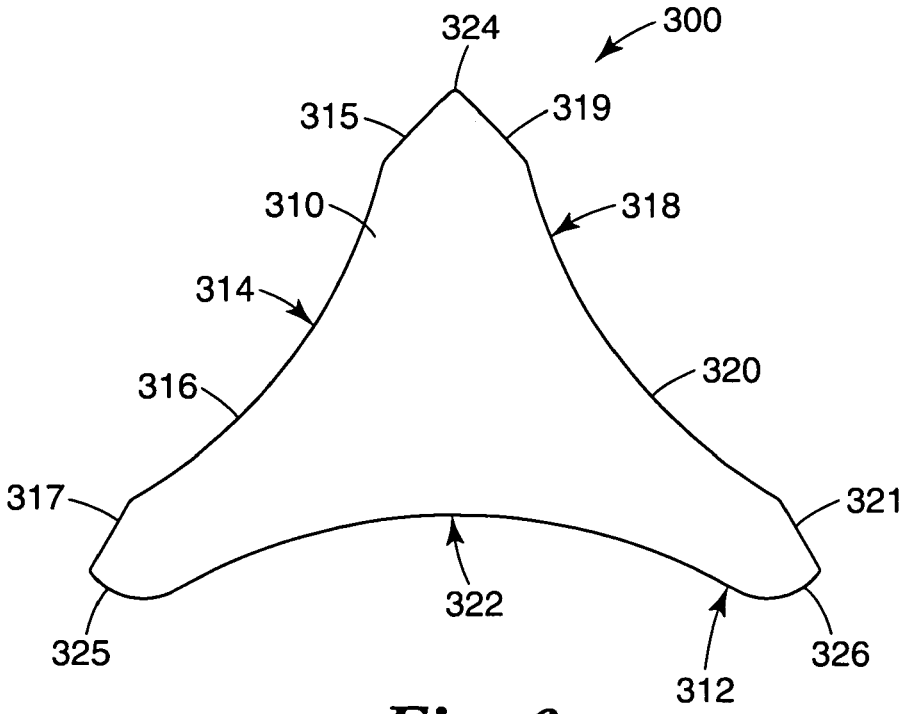
FIG. 6 is a bottom view of an alternative cleaning tool according to the present invention.

FIG. 6 is a bottom view of an alternative cleaning tool 300 according to the present invention. The cleaning tool 300 includes a backing 310 having an overall generally triangular perimeter 312 having a leading point 324, a left trailing corner 325, and a right trailing corner 326. The perimeter 312 includes a first edge 314, a second edge 318, and a concave third edge 322. The first edge 314 has a leading linear portion 315, a trailing linear portion 317, and a concavely curved portion 316 between the leading linear portion 315 and trailing linear portion 317. The second edge 318 has a leading linear portion 319, a trailing linear portion 321, and a concavely curved portion 320 between the leading linear portion 319 and trailing linear portion 321. The leading linear portions 315, 319 meet to form leading point 324.

An exemplary embodiment of cleaning tool 300 has dimensions of approximately 12 inches (30 cm) by 8.5 inches (22 cm) leading to a perimeter of approximately 34 inches (86 cm) and an area of 42 square inches (271 $cm^2$). The concave third edge 322 has a radius of curvature of 9 inches (23 cm), and each concave curved portion 316, 320 has a radius of curvature of 9 inches (23 cm).

Figure 7:
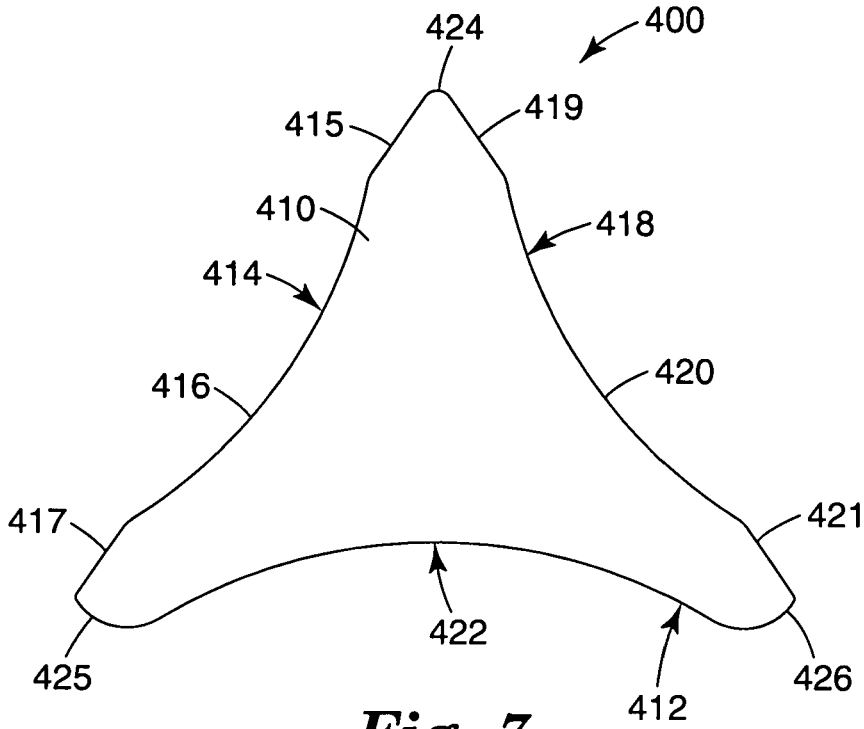
FIG. 7 is a bottom view of an alternative cleaning tool according to the present invention.

FIG. 7 is a bottom view of an alternative cleaning tool 400 according to the present invention. The cleaning tool 400 includes a backing 410 having an overall generally triangular perimeter 412 having a leading point 424, a left trailing corner 425, and a right trailing corner 426. The perimeter 412 includes a first edge 414, a second edge 418, and a concave third edge 422. The first edge 414 has a leading linear portion 415, a trailing linear portion 417, and a concavely curved portion 416 between the leading linear portion 415 and trailing linear portion 417. The second edge 418 has a leading linear portion 419, a trailing linear portion 421, and a concavely curved portion 420 between the leading linear portion 419 and trailing linear portion 421. The leading linear portions 415, 419 meet to form leading point 424.

An exemplary embodiment of cleaning tool 400 has dimensions of approximately 12 inches (30 cm) by 9 inches (23 cm) leading to an overall perimeter of approximately 34 inches (86 cm) and an area of 42 square inches (271 $cm^2$). The concave third edge 422 has a radius of curvature of approximately 9 inches (23 cm), and each concave curved portion 416, 420 have a radius of curvature of approximately 9 inches (23 cm). The leading point 424 is approximately a 69 degree angle.

Figure 8:
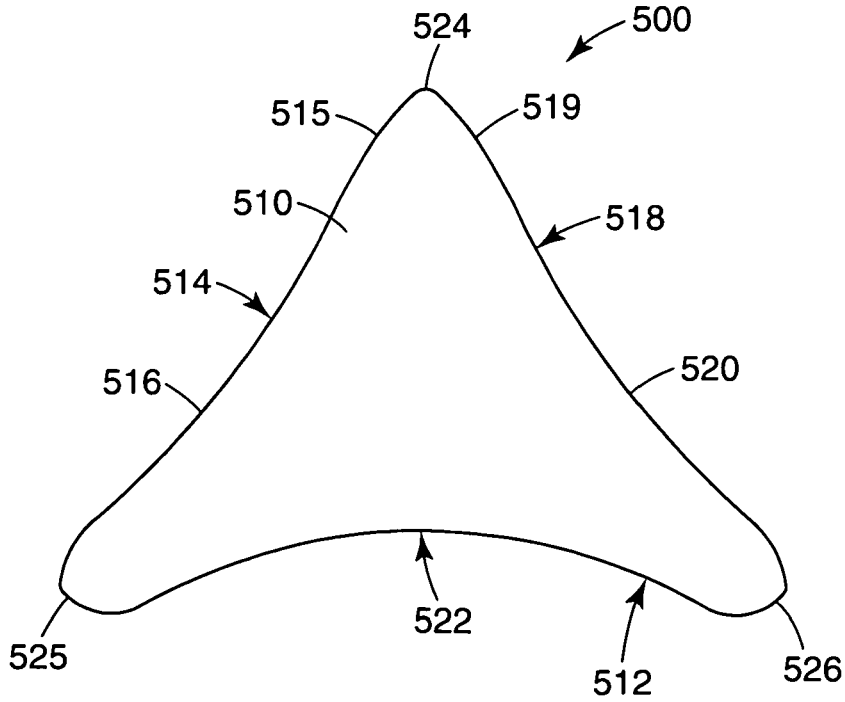
FIG. 8 is a bottom view of an alternative cleaning tool according to the present invention.

FIG. 8 is a bottom view of an alternative cleaning tool 500 according to the present invention. The cleaning tool 500 includes a backing 510 having an overall generally triangular perimeter 512 having a leading point 524, a left trailing corner 525, and a right trailing corner 526. The perimeter 512 includes a first edge 514, a second edge 518, and a concave third edge 522. The first edge 514 has a convex curve portion 515 and a concave curve portion 516. The second edge 518 has a convex curve portion 519 and a concave curve portion 520. The convex curve portions 515, 519 meet to form leading point 524.

An exemplary embodiment of cleaning tool 500 has dimensions of approximately 12 inches (30 cm) by 9 inches (23 cm) leading to an overall perimeter of approximately 34 inches (86 cm) and an area of 47 square inches (303 $cm^2$). The concave third edge 522 has a radius of curvature of approximately 9 inches (23 cm), and each concave curved portion

516, 520 has a radius of curvature of approximately 16 inches (41 cm). Each convex curve portion 515, 519 has a radius of curvature of approximately 4.5 inches (11 cm).

It is understood that FIGS. 5, 6, 7, and 8 each show a bottom view of an exemplary backing for use in the cleaning tool of the present invention. Each of these backings may include a compliant support, a handle pivotally attached to the backing, and a wipe for attaching to the cleaning tool as previously described.

The linear portions on the first edge and second edge, as shown in FIGS. 5, 6, and 7 assist with extending the cleaning tool 100 along a linear vertical edge such as, but not limited to, a baseboard or cabinet. The concave curved portions on the first and second edges shown in FIGS. 5, 6, 7, and 8 assist with providing another surface for scooping debris. Also, these surfaces assist with scooping and capturing larger particles such a sand, dirt, and food crumbs.

Although specific embodiments of this invention have been shown and described herein, it is understood that these embodiments are merely illustrative of the many possible specific arrangements that can be devised in application of the principles of the invention. Numerous and varied other arrangements can be devised in accordance with these principles by those of ordinary skill in the art without departing from the spirit and scope of the invention. Thus, the scope of the present invention should not be limited to the structures described in this application, but only by the structures described by the language of the claims and the equivalents of those structures.

What is claimed is:

1. A floor cleaning tool comprising:

a backing comprising a first surface and a second surface;

a handle attached to the second surface of the backing, wherein the backing has a generally triangular perimeter having a first edge, a second edge, and a third edge;

wherein a portion of the first edge is concavely curved and a portion of the second edge is concavely curved, the first edge and second edge meet at a leading point;

wherein a portion of the third edge is concavely curved.

2. The floor cleaning tool of claim 1, wherein a portion of the first edge is linear and a portion of the second edge is linear.

3. The floor cleaning tool of claim 1, wherein the portion of the third edge that is concavely curved has a radius of curvature from 7 inches to 11 inches (18 cm to 28 cm).

4. The floor cleaning tool of claim 1, further comprising a compliant support attached to the first surface of the backing.

5. The floor cleaning tool of claim 4, wherein the compliant support is selected from the group consisting of plastic, rubber, foam, closed-cell foam, foamed polyurethane and other foamed synthetic and natural materials.

6. The floor cleaning tool of claim 1, wherein the leading point is less than 90 degrees.

7. The floor cleaning tool of claim 1, further comprising a wipe.

8. The floor cleaning tool of claim 7, further comprising means for securing the wipe to the cleaning tool.

9. A floor cleaning tool comprising:

a backing comprising a first surface and a second surface;

a complaint support covering the first surface of the backing;

a handle attached to the second surface of the backing;

wherein the backing has a generally triangular perimeter having a first edge, a second edge, and a third edge;

wherein the first edge includes a concave portion and a linear portion, the second edge includes a concave portion and a linear portion, and the third edge is concave;

wherein the floor cleaning tool is capable of supporting a wipe.

10. The floor cleaning tool of claim 9, wherein the third edge has a radius of curvature of from 7 inches to 11 inches (18 cm to 28 cm).

11. The floor cleaning tool of claim 9, wherein the first edge and second edge meet at a leading point, wherein the leading point is less than 90 degrees.

12. The floor cleaning tool of claim 9, wherein the wipe is a disposable non-woven wipe.

13. The floor cleaning tool of claim 9, further comprising means for securing the wipe to the cleaning tool.

* * * * *